US011705006B2

(12) United States Patent
Weston et al.

(10) Patent No.: US 11,705,006 B2
(45) Date of Patent: Jul. 18, 2023

(54) SYSTEMS AND METHODS TO ISSUE A WARNING TO AN OBJECT NEAR A VEHICLE

(71) Applicant: Ford Global Technologies, LLC, Dearborn, MI (US)

(72) Inventors: Keith Weston, Canton, MI (US); Jordan Barrett, Milford, MI (US); Andrew Denis Lewandowski, Sterling Heighls, MI (US); Brendan Diamond, Grosse Pointe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 120 days.

(21) Appl. No.: 17/465,585

(22) Filed: Sep. 2, 2021

(65) Prior Publication Data

US 2023/0064517 A1 Mar. 2, 2023

(51) Int. Cl.

| | |
|---|---|
| ***G08G 1/16*** | (2006.01) |
| ***G08G 1/01*** | (2006.01) |
| ***G08G 1/04*** | (2006.01) |
| ***G08G 1/005*** | (2006.01) |

(52) U.S. Cl.
CPC ..... *G08G 1/166* (2013.01); *G08G 1/005* (2013.01); *G08G 1/0112* (2013.01); *G08G 1/04* (2013.01)

(58) Field of Classification Search
CPC ..... G08G 1/166; G08G 1/005; G08G 1/0112; G08G 1/04
See application file for complete search history.

(56) References Cited

U.S. PATENT DOCUMENTS

| | | | | |
|---|---|---|---|---|
| 10,818,167 | B2 | 10/2020 | Lu et al. | |
| 2016/0075332 | A1* | 3/2016 | Edo-Ros | B60T 7/22 701/70 |
| 2018/0033306 | A1* | 2/2018 | Kim | G06V 40/103 |
| 2018/0233048 | A1* | 8/2018 | Andersson | G08G 1/166 |
| 2018/0284234 | A1 | 10/2018 | Curato | |
| 2019/0258878 | A1 | 8/2019 | Koivisto et al. | |

(Continued)

OTHER PUBLICATIONS

Pasy Pyykonen et al., "Developing intelligent blind spot detection system for Heavy Goods Vehicles", IEEE, Sep. 3-5, 2015, 6 pages.

(Continued)

*Primary Examiner* — Sisay Yacob
(74) *Attorney, Agent, or Firm* — Frank Lollo; Eversheds Sutherland (US) LLP

(57) ABSTRACT

The disclosure generally pertains to systems and methods for issuing a hazard warning to an animate object located in a vicinity of a vehicle. In an example method, a processor in a warning system of a vehicle, detects an animate object (a person or an animal) in the vicinity of a first vehicle and determines a hazard posed to the animate object. The hazard, which may be caused by the first vehicle or another vehicle that is moving in a collision course with the animate object, can be evaluated by determining a trajectory of the animate object and a trajectory of the vehicle. If the probability of intersection of the two trajectories exceeds a threshold intersection probability level, the processor recognizes a hazard and issues a warning to the animate object (a horn beep, flashing lights, or a text message to a smart device of the person).

16 Claims, 5 Drawing Sheets

(56) References Cited

U.S. PATENT DOCUMENTS

| | | | | |
|---|---|---|---|---|
| 2020/0018613 | A1* | 1/2020 | Stenneth | G08G 1/048 |
| 2020/0154030 | A1 | 5/2020 | Kiser et al. | |
| 2020/0294401 | A1 | 9/2020 | Kerecsen | |
| 2020/0361483 | A1* | 11/2020 | Yonushonis | B60W 30/0956 |
| 2020/0398743 | A1* | 12/2020 | Huber | B60Q 1/50 |

OTHER PUBLICATIONS

Jose Javier Anaya et al., "Motorcycle detection for ADAS through camera and V2V Communication, a comparative analysis of two modern technologies", ResearchGate, Elsevier, Jan. 2017, 13 pages.
C.S.Arvind et al, "Autonomous RL: Autonomous Vehicle Obtacle Avoidance in a Dynamic Environment using MLP-SARSA Reinforcement Learning", 2019 IEEE Fifth International Conference on Mechatronics System and Robots, May 3-5, 2019, 5 pages.

* cited by examiner

SYSTEMS AND METHODS TO ISSUE A WARNING TO AN OBJECT NEAR A VEHICLE

BACKGROUND

Warning systems in vehicles are typically configured to warn a driver of the vehicle about various situations, objects, and conditions. Such warning systems include several types of sensors and detection capabilities that may prove useful for various other types of applications and scenarios. It is therefore desirable to expand the use of the sensors for performing various hitherto unrecognized and unimplemented tasks.

BRIEF DESCRIPTION OF THE DRAWINGS

A detailed description is set forth below with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
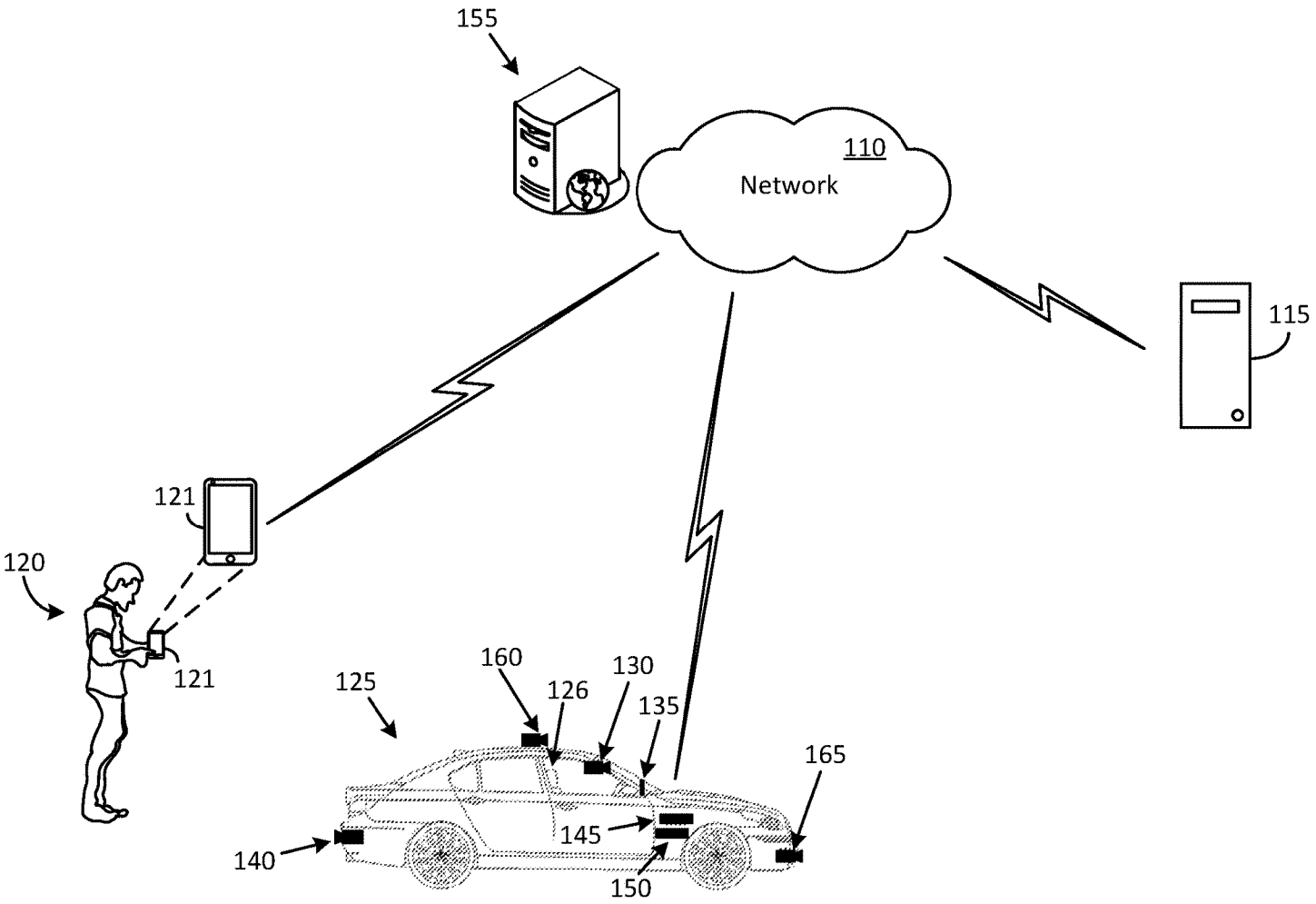
FIG. 1 illustrates an example vehicle that includes a warning system in accordance with an embodiment of the disclosure.

In terms of a general overview, certain embodiments described in this disclosure are directed to systems and methods for issuing a warning to an individual and/or an animal moving in a vicinity of a vehicle. In an example method, a processor in a warning system of a vehicle detects an animate object (a person or an animal) in the vicinity of a first vehicle and determines a hazard posed to the animate object. The hazard could be caused by the first vehicle or another vehicle that is moving in a collision course with the animate object. A probability of intersection can be evaluated by determining a trajectory of the animate object and a trajectory of the first vehicle or the other vehicle. If the probability of intersection of the two trajectories exceeds a threshold intersection probability level, the processor recognizes a hazard and may issue a warning to the animate object such as, for example, a horn beep, flashing lights, or a text message to a smart device of the person.

Illustrative Embodiments

The disclosure will be described more fully hereinafter with reference to the accompanying drawings, in which example embodiments of the disclosure are shown. This disclosure may, however, be embodied in many different forms and should not be construed as limited to the example embodiments set forth herein. It will be apparent to persons skilled in the relevant art that various changes in form and detail can be made to various embodiments without departing from the spirit and scope of the present disclosure. Thus, the breadth and scope of the present disclosure should not be limited by any of the described example embodiments but should be defined only in accordance with the claims and their equivalents. The description below has been presented for the purposes of illustration and is not intended to be exhaustive or to be limited to the precise form disclosed. It should be understood that alternate implementations may be used in any combination desired to form additional hybrid implementations of the present disclosure. For example, any of the functionality described with respect to a particular device or component may be performed by another device or component. More particularly, it must be understood that the description with respect to battery charging stations in a battery charging, lot does not in any way preclude implementation of the disclosure upon battery charging stations that are located elsewhere, such as, for example, in a parking space of a private or a public entity.

Furthermore, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments.

Certain words and phrases are used herein solely for convenience and such words and terms should be interpreted as referring to various objects and actions that are generally understood in various forms and equivalencies by persons of ordinary skill in the art. For example, the word "vehicle" as used, in this disclosure encompasses various types of vehicles such as, for example, a sedan, a sports utility vehicle, a truck, a van, a bus, a driver-operated vehicle, a semi-autonomous vehicle, or an autonomous vehicle. The word "image" as used herein can be a standalone digital image or an image that is a part of a video clip or video stream. The phrase "animate object" as used herein encompasses any creature that is capable of movement, and includes human beings as well as various living creatures such as, for example, animals, reptiles, mammals, rodents, and birds. Word such as "detector" and "sensor" may be used interchangeably and must be understood in the context used. Words such as "warning," "instruction," "guidance," "command," or "advisory," as used herein refers to any of various forms of communication such as, for example, a command to a device for performing an operation, a sound emitted through a device (a horn, for example), a voice instruction issued through a speaker of a device (a loudspeaker, for example), a flashing light, a message displayed on a display screen of a device that is either a part of a vehicle or carried by a person. In one case, an advisory may instruct a driver of a vehicle to, perform certain operations and/or to refrain from performing certain other operations. In another case, a command may be sent to a vehicle computer for performing some action upon the vehicle (stopping, braking, honking a horn, etc.). It must be understood that words such as "implementation," "scenario," "case," "application." "procedure," and "situation" are shortened versions of phrases that include either of the following suffixes: "in accordance with the disclosure," or "in accordance with an embodiment of the disclosure." It should be understood that the word "example" as used herein is intended to be non-exclusionary and non-limiting in nature.

FIG. 1 illustrates an example vehicle 125 that includes a warning system 150 configured to communicate with various devices in accordance with an embodiment of the disclosure. In an example embodiment, the warning system 150 includes a computer that is located in a vehicle 125. In another example embodiment, the warning system 150 may be distributed over one or more other computers that cooperate with the computer in the vehicle 125 to execute various operations in accordance with the disclosure. The other computers can include, for example, a personal communication device of a driver 126 of the vehicle 125, a server computer 115, and/or a cloud computer 155.

The vehicle 125 may be any of various types of vehicles such as, for example, a sedan, a sports utility vehicle, a truck, a van, a driver-operated vehicle, a semi-autonomous vehicle, or an autonomous vehicle. In the illustrated example, the vehicle 125 is, operated by a driver 126. In another example, the vehicle 125 is an autonomous vehicle. The vehicle 125 can include components such as, for example, a vehicle computer 145, an infotainment system 135, the warning system 150, and various sensors and detection devices that are included in a sensor system provided in the vehicle 125.

The vehicle computer 145 may perform various functions such as controlling engine operations (fuel injection, speed control, emissions control, braking, etc.), managing climate controls (air conditioning, heating etc.), activating airbags, issuing warnings (check engine light, bulb failure, low tire pressure, vehicle in blind spot, etc.), and activating various vehicle components such as the horn and lights.

In the illustrated scenario, the warning system 150 is configured to execute various operations associated with detecting a hazard posed by one or more vehicles to an animate object and issuing a warning to warn the animate object of the hazard. The animate object can be any living creature that is capable of movement, such as, for example, the individual 120 who is illustrated in FIG. 1. The warning can be provided in various ways such as, for example, by sounding a horn of the vehicle 125, by flashing one or more lights of the vehicle 125, or by transmitting a warning to the personal communication device 121 of the individual 120.

Some of these operations such as, for example, the hazard detection and warning, may be performed autonomously by the warning system 150 without human participation (driver 126 or the individual 120). Some other operations such as, for example, taking avoidance action (braking, swerving, slowing, etc.) may be performed by the driver 126 and/or the vehicle computer 145 based on commands provided by the warning system 150.

As a part of an arrangement to perform such operations, the warning system 150 may be communicatively coupled to the vehicle computer 145 and/or the infotainment system 135 via wired and/or wireless connections. More particularly, in one implementation, the warning system 150 is communicatively coupled to the vehicle computer 145 and the infotainment system 135 via a vehicle bus that uses a controller area network (CAN) bus protocol, a Media Oriented Systems Transport (MOST) bus protocol, and/or a CAN flexible data (CAN-FD) bus protocol. In another implementation, a portion of the warning system 150 such as, for example, trajectory-related computation software, may be provided in the server computer 115 and/or the cloud computer 155. The server computer 115 and the cloud computer 155 may be configured to communicate with the vehicle computer 145 and/or the infotainment system 135 via wireless technologies such as Wi-Fi, Ultra-Wideband (UWB), or cellular communications.

In yet another implementation, a portion of the warning system 150 may be provided in the personal communication device 121 such as, for example, hardware/software for displaying a warning message or producing a warning sound in response to communication received from the warning system 150. The personal communication device 121 may communicate with the vehicle computer 145 and/or the infotainment system 135 via wireless technologies such as cellular, Bluetooth®, Ultra-Wideband (UWB), Wi-Fi, or Zigbee®.

The infotainment system 135 can include elements such as, for example, a radio, an MP3 player, a global positioning system (GPS) device, a clock, and a display screen. The infotainment system 135 can further include a graphical user interface (GUI) or a human machine interface (HMI) that is displayed on the display screen. The GUI or HMI accepts input from an occupant of the vehicle 125 (the driver 126, for example), and/or displays various items pertaining to operations related to detecting hazards and issuing hazard warnings in accordance with the disclosure. An example item that may be displayed on the display screen of the infotainment system 135 can be an advisory provided by the warning system 150 instructing the driver 126 to brake in order to avoid colliding with an animate object.

The warning system 150 may be configured to communicate via a network 110 with various devices such as, for example, the server computer 115 and the cloud computer 155. The server computer 115 and the cloud computer 155 may be configured to provide to the warning system 150, information such as, for example, results of trajectory computations, road rules, and regulatory procedures related to driving. In some applications, the warning system 150 may be further configured to communicate with computers in other vehicles by using vehicle-to-vehicle (V2V) communications and with various infrastructure objects located outside the vehicle 125 by using vehicle-to-infrastructure (V2I) communications. In an example implementation, the warning system 150 may use V2V communication to communicate with a computer in another vehicle to convey a warning about an animate object that may be present on or near a road.

The network 110 may include any one, or a combination of networks, such as a local area network (LAN), a wide area network (WAN), a telephone network, a cellular network, a cable network, a wireless network, and/or private/public networks such as the Internet. For example, the network 110 may support communication technologies such as Wi-Fi, Wi-Fi direct, Ultra-Wideband (UBW), machine-to-machine communication, and/or man-to-machine communication.

At least one portion of the network 110 includes a wireless communication link (a WiFi link, for example), that allows the warning system 150 and/or the infotainment system 135 of the vehicle 125 to communicate with the server computer 115 and/or the cloud computer 155. The network 110 may also support a wireless communication link (a cellular link, for example) that allows the server computer 115 and/or the cloud computer 155 to communicate with the personal communication device 121 carried by the individual 120. The personal communication device 121 can be any of various smart devices such as, for example, a smartphone, a tablet computer, a phablet (phone plus tablet), a wearable computer, or a laptop computer.

The vehicle 125 may include various sensors and detection devices that are communicatively coupled to the warning system 150 and/or the vehicle computer 145. A few examples of such sensors and detection devices can include a camera, an ultrasonic sensor, a radar sensor, a light detection and ranging (LIDAR) detector, and a global positioning system (GPS) device. Sensors and detectors such as the ultrasonic sensor, the radar sensor, and the LIDAR detector may be configured as object detectors for detecting objects outside the vehicle 125.

In the illustrated example, the detection devices include a camera 130, a camera 165, a camera 140, and a camera 160. The camera 130, which can be mounted on a rear-view mirror or a dashboard of the vehicle 125, and the camera 165, which can be mounted on a front bumper of the vehicle 125, are arranged to capture images of objects located in front of the vehicle 125. The camera 140, which can be mounted on a rear bumper of the vehicle 125, is arranged to capture images of objects located behind the vehicle 125. The camera 160 may be mounted on the roof of the vehicle 125 to capture images of objects located at various locations around the vehicle 125.

In an example implementation, the camera 160 is an imaging system containing multiple cameras arranged to provide a 360° view all around the vehicle 125 and to convey to the warning system 150, captured images of multiple objects all around the vehicle 125. The camera 130, the camera 165, the camera 140, and/or the camera 160 can be any of various types of cameras, including, for example, a digital camera that captures digital images, a video camera that produces, video clips and/or streaming video, and a night-vision camera that captures images and/or video in low light conditions. The images, video, and/or streaming video may be conveyed to the warning system 150. The warning system 150 may evaluate the images, video, and/or streaming video for various, purposes such as, for example, to detect the presence of an animate object in the vicinity of the vehicle 125.

Figure 2:
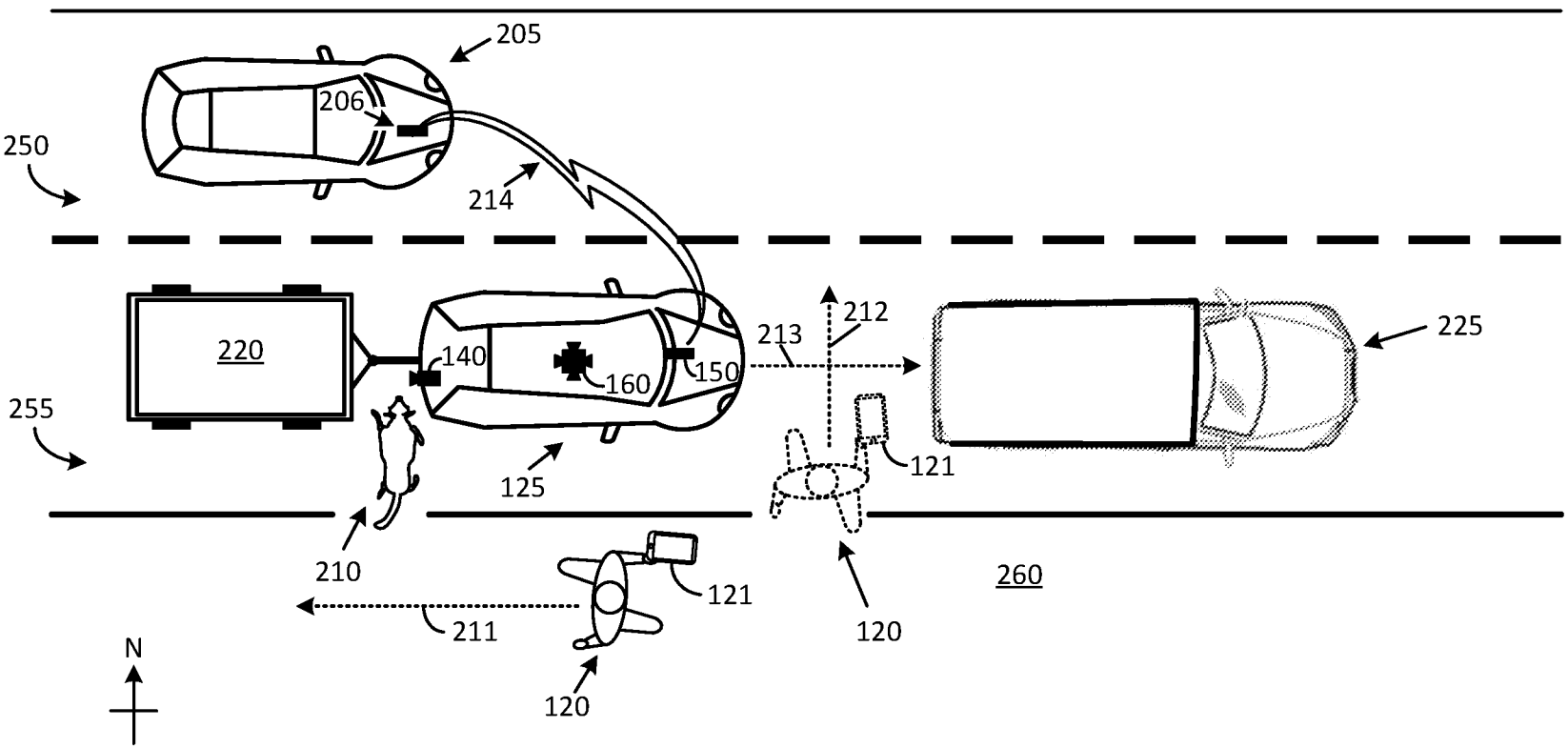
FIG. 2 illustrates an example scenario where the warning system can be operated in accordance with an embodiment of the disclosure.

FIG. 2 illustrates an example scenario where the warning system 150 provided in the vehicle 125 can be operated in accordance with an embodiment of the disclosure. The vehicle 125 is traveling east in a lane 255 on a multi-lane highway. A vehicle 225 traveling ahead of the vehicle 125, can be any of various types of vehicles, including a two-wheeled vehicle or a three-wheeled vehicle. Another vehicle 205 is also traveling east on a lane 250 of the multi-lane highway, slightly behind the vehicle 125. A driver of the vehicle 205 may have a line-of-sight view of a rear portion of the vehicle 125 and a portion of a trailer 220 that is hitched to the vehicle 125.

In the illustrated scenario, an individual 120 is walking on a sidewalk 260. His/her direction of movement runs substantially parallel to the multi-lane highway. One or more sensors of the sensor system in the vehicle 125 may detect the individual 120 and convey information to the warning system 150. In an example implementation, the camera 215 may capture a set of images of the individual 120 and convey the images to the warning system 150. The warning system 150 may evaluate the images to identify a trajectory 211 of the individual 120. The set of images can be sequential images that are a part of a video clip or video stream provided by the camera 215. The warning system 150 may also evaluate other factors such as, for example, a direction of gaze of the individual 120, and/or an orientation of a part of a body of the individual 120 (torso, chest, face, etc.) to identify the trajectory 211. In this example scenario, the warning system 150 may conclude, based on the trajectory 211 of the individual 120 and a trajectory 213 of the vehicle 125, that the individual 120 is not moving in a collision course with either the vehicle 125 or the trailer 220, and consequently, the vehicle 125 and/or the trailer 220 do not pose a hazard to the individual 120.

In an alternative scenario, the individual 120 is stepping off the sidewalk 260 and into the lane 255 (as illustrated in a dotted line format in FIG. 2). One or more sensors of the sensor system in the vehicle 125 may detect the individual 120 and convey information to the warning system 150. For example, an object detector (such as, for example, an ultrasonic detector, a radar detector, or a LIDAR detector) may detect the individual 120 and convey one or more signals to the warning system 150. The radar detector may also provide a sequence of signals that indicate to the warning system 150 that the individual 120 is moving in a direction indicated by the trajectory 212. In lieu of, or in addition to, the signals provided by the ultrasonic detector and/or the radar detector, the camera 215 may capture a set of images of the individual 120 and convey the images to the warning system 150 for identifying the trajectory 212. The warning system 150 may evaluate the images to identify and/or to confirm, the trajectory 212 of the individual 120. In one implementation, the warning system 150 may evaluate a number of sequential images (from a video clip or video stream provided by the camera 215, for example), a direction of gaze of the individual 120, and/or an orientation of a part of a body of the individual 120 (torso, chest, face, etc.) to identify the trajectory 212. In this example scenario, the warning system 150 may conclude, based on the trajectory 212 of the individual 120, that the individual 120 is moving in a collision, course with the vehicle 125. Consequently, the warning system 150 transmits a warning to the individual 120 to alert him/her of the hazard posed by the vehicle 125. The warning system 150 may also cooperate with the vehicle computer 145 to execute certain operations upon the vehicle 125 such as, for example, stopping, slowing down, or changing lanes to avoid colliding with the individual 120. These operations may be carried out autonomously when the vehicle 125 is an autonomous vehicle, and with or without the participation of the driver 126 when the vehicle 125 is a driver-operated vehicle.

The warning issued to the individual 120 may be provided in one or more of various forms. In one case, the warning system 150 may communicate with the vehicle computer 145 to activate a horn of the vehicle 125. The sound emitted by the horn serves as a warning in this case. In another case, the warning system 150 may communicate with the vehicle computer 145 to activate one or more lights the vehicle 125 such as for example, to flash the headlights, hazard lights, and/or running lights. The flashing light(s) serves as a warning in this case. In another case, the warning system 150 may issue an audible warning to the individual 120 through a speaker system of the vehicle 125 such as, for example, "Please watch out" or "Step back." In another case, the warning system 150 may communicate with the personal communication device 121 of the individual 120 to provide a warning through the personal communication device 121. The warning provided by personal communication device 121 can be an audible warning (such as, for example, an, incessant buzzing sound, a beep, or an audio message) or a visual warning (such as, for example, a text message).

In another embodiment, the warning system 150 may determine the speed of the vehicle 125 (based on input received from a speed sensor in the vehicle 125 and/or from the vehicle computer 145) and may also determine a walking speed of the individual 120 (based on input received from a radar detector or an ultrasonic detector). The warning system 150 may evaluate the speed of the vehicle 125, a current location of the individual 120, and the walking speed of the individual 120, to determine a probability of collision between the vehicle 125 and the individual 120. If the probability of collision is below a threshold collision probability level, the warning system 150 may refrain from issuing a warning to the individual 120. The threshold collision probability level may be preset by various entities such as, for example, a manufacturer of the vehicle 125, a vehicle dealership, or the driver 126 of the vehicle 125. In one implementation, the threshold collision probability level may be defined as a percentage (10% probability of a collision, 50% probability of a collision, 90% probability of a collision, etc.).

The warning system 150 may also wirelessly communicate (via V2V communications over a wireless link 214, for example) with a warning system 206 (or a vehicle computer) of the vehicle 205 to alert the vehicle 205 about the individual 120 who may move into the lane 250 in front of the vehicle 205. Conversely, in some situations, the warning system 206 of the vehicle 205 may communicate with the warning system 150 to convey information including, for example, a hidden object that is undetectable by a sensor of the vehicle 125 but may be vulnerable to a hazard that may be caused by the vehicle 125.

In another situation, the vehicle 125 may be in a stopped (or parked) state and consequently, the vehicle 125 and/or the trailer 220 do not pose a hazard to the individual 120. The warning system 150 may refrain from issuing a warning to the individual 120 and may communicate an advisory to the driver 126 (via the infotainment system 135) to watch out for the individual 120 and use discretion when driving forward.

In yet another situation, the vehicle 125 may be in a stopped (or parked) state as a result of an emergency (engine failure, flat tire, etc.) and an individual such as, for example, an emergency responder, a medic, a police officer, or the driver 126 of the vehicle 125 may be located on a driver side of the vehicle 125. In some situations, a portion of a body of the individual may be projecting into the lane 250, or the individual 120 may step backwards on to the lane 250. The warning system 150 may evaluate images and identify a possibility that the vehicle 205 may collide with the individual. Upon identifying such a hazard, the warning system 150 may issue a warning to the individual and/or may transmit an advisory to warn the vehicle 205.

In another example scenario, an animate object such as for example, an animal, may move into the lane 255 and risk being struck by the vehicle 125 and/or the trailer 220. In the example illustration shown in FIG. 2, a dog 210 is moving north between the vehicle 125 and the trailer 220 that is hitched to the vehicle 125. The vehicle 125 (with the trailer 220 attached) may be moving, in one case, and may be stopped or parked in another case.

An object detector (such as, for example, an ultrasonic detector, a radar detector, or a LIDAR detector) may detect the dog 210 and send a signal to the warning system 150. The warning system 150 may activate a camera such as, for example, the camera 140, to capture an image or produce a video clip/video stream, that includes the dog 210 and surrounding objects. The warning system 150 may then evaluate the images in various ways such as in the manner described above (trajectory, body orientation, speed, location, etc.) and determine whether the trailer 220 poses a hazard to the dog 210. If the trailer 220 does, indeed pose a hazard to the dog 210, the warning system 150 may transit a warning to warn the dog 210 of the hazard and to encourage the dog 210 to avoid getting hurt. The warning may be provided in the form of a honked horn or any other form of sound that draws the attention of the dog 210.

In another situation, the vehicle 125 may be in a stopped (or parked) state and consequently, the vehicle 125 and/or the trailer 220 do not pose a hazard to the dog 210. The warning system 150 may refrain from issuing a warning and, may issue an advisory to, the driver 126 (via the infotainment system 135) of the vehicle 125 to watch out for the dog 210 and use discretion when driving forward. The warning system 150 may also wirelessly communicate (via V2V communications, for example) with the warning system 206 (or a vehicle computer) of the vehicle 205 to alert the vehicle 205 about the dog 210 which may move into the lane 250 from an area between the parked vehicle 125 and the trailer 220. The wireless link 214 operates bi-directionally and the warning system 206 may communicate various types of information to the warning system 150 such as, for example, to alert the warning system 150 of the dog 210.

Figure 3:
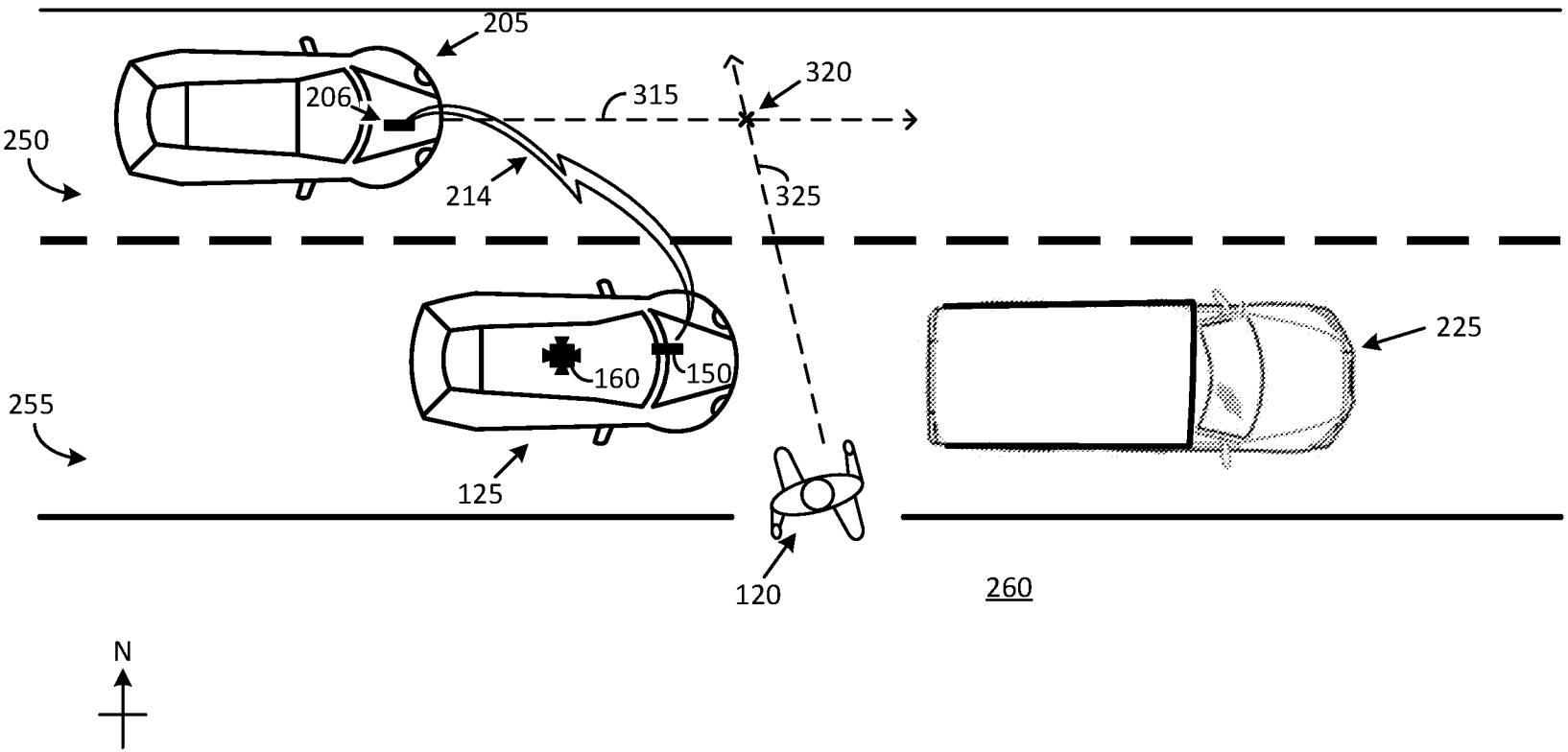
FIG. 3 illustrates another example scenario where the warning system can be operated in accordance with an embodiment of the disclosure.

FIG. 3 illustrates another example scenario where the warning system 150 provided in the vehicle 125 can be operated in accordance with an embodiment of the disclosure. The locations of the vehicle 125, the vehicle 225, and the vehicle 205 are as described above. The individual 120 is stepping off the sidewalk 260 and into the lane 255 (as illustrated in a dotted line format in FIG. 3). One or more sensors of the sensor system in the vehicle 125 may detect the individual 120 and convey information to the warning system 150. The warning system 150 may activate the camera 215 for capturing one or more images of the individual 120 and of the vehicle 205.

In one implementation, the warning system 150 may evaluate a number of sequential images (from a video clip or video stream provided by the camera 215, for example), a direction of gaze of the individual 120, and/or an orientation of a part of a body of the individual 120 (torso, chest, face, etc.) to identify the trajectory 325. The warning system 150 may evaluate a number of sequential images (from a video clip or video stream provided by the camera 215 for example) of the vehicle 205 to identify a trajectory 315 of the vehicle 205.

The warning system 150 may then identify, based on the trajectory 325 of the individual 120 and, the trajectory 315 of the vehicle 205 that the vehicle 205 that a probability of collision between the vehicle 205 and the individual 120 at a collision spot 320 exceeds a threshold collision probability level and/or a threshold intersection probability level. In an alternative implementation, the warning system 150 may opt not to determine the trajectory 315 of the vehicle 205 and may identify, based on the trajectory 325 of the individual 120, that a probability of collision between the vehicle 205 and the individual 120 at any spot inside the lane 250 exceeds a threshold collision probability level.

Upon determining that the probability of a collision exceeds the threshold collision probability level (in any implementation), the warning system 150 transmits a warning to the individual 120 to alert him/her of the hazard posed by the vehicle 205. The warning issued to the individual 120 may be provided in one or more of various forms. In one case, the warning system 150 may communicate with the vehicle computer 145 to activate a horn of the vehicle 125. The sound emitted by the horn serves as a warning in this case. In another case, the warning system 150 may communicate with the vehicle computer 145 to activate one or more lights the vehicle 125 such as, for example, to flash the headlights, hazard lights, and/or running lights. The flashing light(s) serves as a warning in this case. In another case, the warning system 150 may issue an audible warning to the individual 120 through a speaker system of the vehicle 125 such as, for example, "Please watch out" or "Step back." In another case, the warning system 150 may communicate with the personal communication device 121 of the individual 120 to provide a warning through the personal communication device 121. The warning provided by personal communication device 121 can be an audible warning (such as, for example, incessant buzzing sound, a beep, or an audio message) or a visual warning (such as, for example, a text message). The warning system 150 may also communicate (via V2V communications over the wireless link 214, for example) with the warning system 206 of the vehicle 205 to alert the vehicle 205 about the individual 120 who may move into the lane 250 in front of the vehicle 205.

In another embodiment, the warning system 150 may determine the speed of the vehicle 205 (based on evaluating a sequence of images captured by the camera 215) and may also determine a walking speed of the individual 120 (based on input received from a radar detector or an ultrasonic detector). The warning system 150 may evaluate the speed of the vehicle 205, a current location of the individual 120, the walking speed of the individual 120, a direction of movement of the individual 120, to determine a probability of collision between the vehicle 205 and the individual 120. If the probability of collision is below a threshold collision probability level, the warning system 150 may refrain from issuing, a warning to the individual 120.

In another situation, the vehicle 125 may be in a stopped (or parked) state when the individual 120 steps on to the lane 255 and moves towards the lane 250. The warning system 150 may evaluate the movement of the individual 120 and of the vehicle 205 in the manner described above, in order to determine a probability of collision between the vehicle 205 and the individual 120. The warning system 150 may then issue a warning or refrain from issuing a warning, based on comparing the probability of collision to a threshold collision probability level.

The description provided above with respect to the warning system 150 detecting and warning the vehicle 205 of the individual 120 is equally applicable to any of various other animate objects, including the dog 210 shown in FIG. 2.

Figure 4:
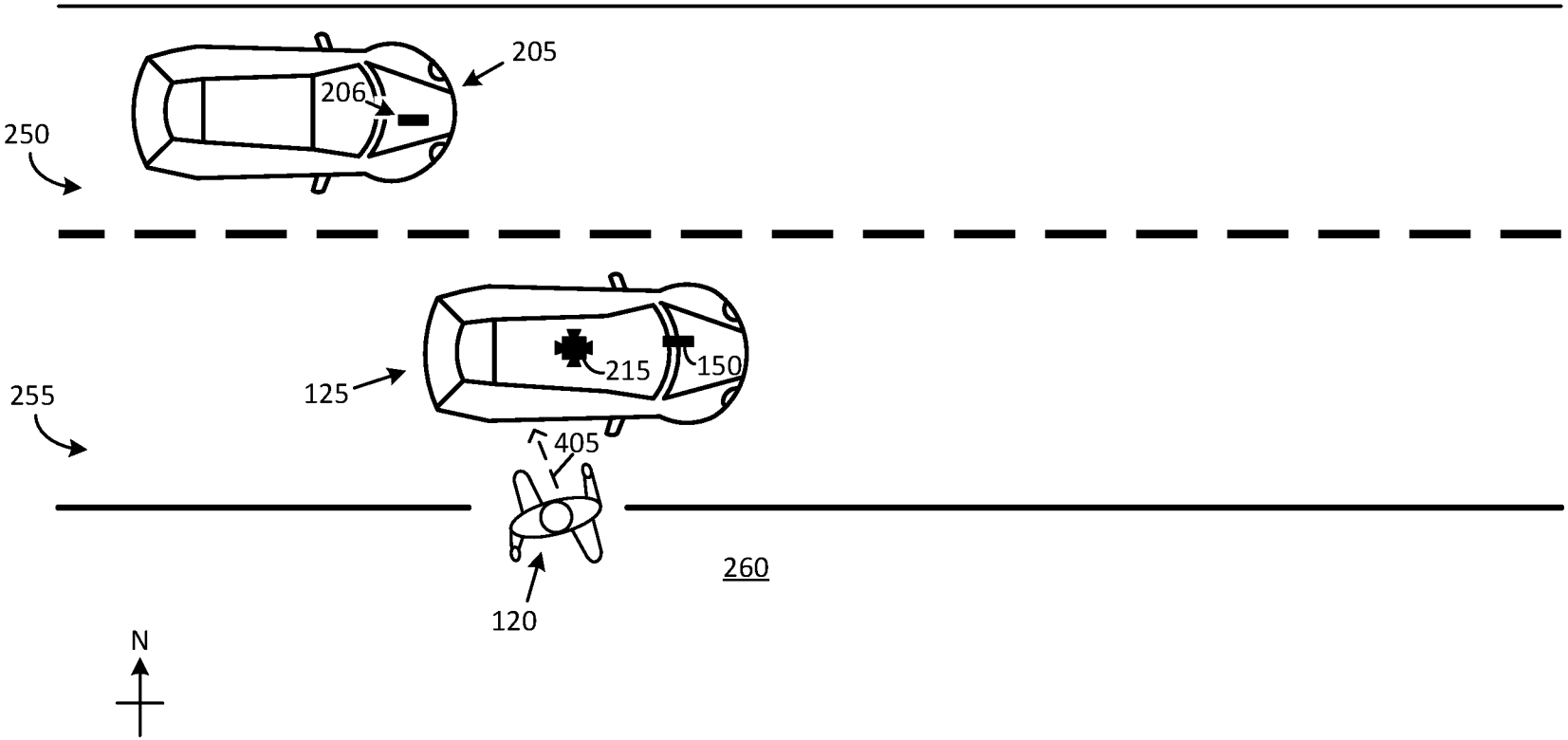
FIG. 4 illustrates yet another example scenario where the warning system can be operated in accordance with an embodiment of the disclosure.

FIG. 4 illustrates another example scenario where the warning system. 150 provided in the vehicle 125 can be operated in accordance with an embodiment of the disclosure. The locations of the vehicle 125, the vehicle 225, and the vehicle 205 are as described above. The individual 120 is stepping off the sidewalk 260 and into the lane 255. One or more sensors of the sensor system in the vehicle 125 may detect the individual 120 and convey information to the warning system 150. The warning system 150 may activate the camera 215 for capturing one or more images of the individual 120 and of the vehicle 205.

In one implementation, the warning system 150 may evaluate a number of sequential images (from a video clip or video stream provided by the camera 215, for example), a direction of gaze of the individual 120, and/or an orientation of a part of a body of the individual 120 (torso, chest, face, etc.) to identify the trajectory 405, a current location, and a walking, speed of the individual 120.

The warning system 150 may then determine the speed of the vehicle 125 (based on input received from a speed sensor in the vehicle 125 and/or from the vehicle computer 145) and may determine based on the speed of the vehicle 125 and the trajectory 405, current location, and walking speed of the individual 120 that a probability of collision between the vehicle 125 and the individual 120 is lower than a threshold collision probability level. Consequently, the warning system 150 will refrain from issuing a warning to the individual 120 and/or may execute actions such as, for example, increasing a speed of the vehicle 125 or changing lanes. In one implementation, the warning system 150 may also detect the speed of the vehicle 205 and determine that a probability of collision between the vehicle 205 and the individual 120 is lower than a threshold collision probability level. Consequently, the warning system 150 will refrain from communicating a warning to the warning system 206 of the vehicle 205.

Figure 5:
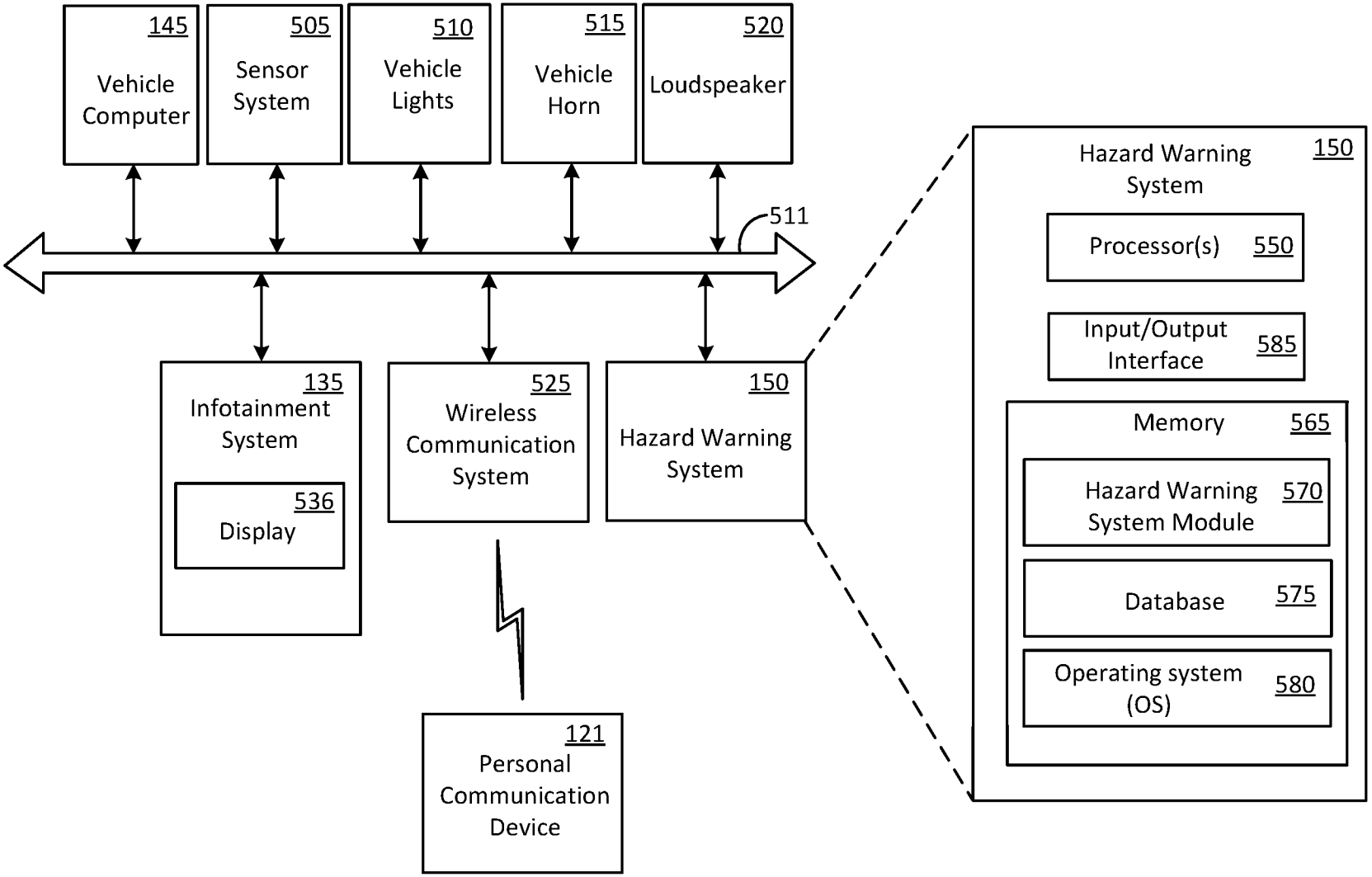
FIG. 5 shows some example components that may be included in a vehicle that includes a warning system in accordance with an embodiment of the disclosure.

FIG. 5 shows some example components that may be provided in the vehicle 125 in accordance with an embodiment of the disclosure. The example components in the vehicle 125 can include the vehicle computer 145, a sensor system 505, vehicle lights 510, a vehicle horn 515, a loudspeaker 520, the infotainment system 135, a wireless communication system 525, and the warning system 150, which are communicatively coupled to each other via a bus 511. The bus 511 can be implemented using one or more of various wired and/or wireless technologies. For example, the bus 511 can be a vehicle bus that uses a controller area network (CAN) bus protocol, a Media Oriented Systems Transport (MOST) bus protocol, and/or a CAN flexible data (CAN-FD) bus protocol. Some or all portions of the bus 511 may also be implemented using wireless technologies such as Bluetooth®, ZigBee®, Ultra-Wideband (UWB), near-field-communications (NFC), cellular, Wi-Fi, Wi-Fi direct, machine-to-machine communication, and/or man-to-machine communication.

The sensor system 505 may include various sensors and detection devices that are communicatively coupled to the warning system 150 and/or the vehicle computer 145. A few examples of such sensors and detection devices can include a camera, an ultrasonic sensor, a radar detector, a LIDAR detector, a global positioning system (GPS), and a vehicle speed sensor.

The vehicle lights 510 can include various types of light sources such as, for example, headlights, side lights, hazard lights, running lights, and cabin light. Light emitted by these light sources is visible to an animate object located outside the vehicle 125 and can be used to warn the animate object of a hazard.

The loudspeaker 520 can be mounted at any of various locations on the vehicle 125 and configured for broadcasting audible warnings to animate objects located outside the vehicle 125. The audible warnings can include messages such as, for example, "Please watch out" or "Step back," that may be broadcast to warn the individual 120 of a hazard.

The vehicle lights 510, the vehicle horn 515, and the loudspeaker 520 can be activated by the vehicle computer 145 or by the warning system 150. When activated by the warning system 150, the vehicle computer 145 may receive commands from the warning system 150 ("Activate horn" or "Flash headlight" for example) and/or advisories from the warning system 150 ("Broadcast the message 'Step back' from the loudspeaker 520," for example).

The infotainment system 135 can be an integrated unit that includes various components such as, for example, a radio, an MP3 player, and a display 536. The display 536 may include a graphical user interface (GUI) for use by the driver 126 to observe information and/or messages provided by the warning system 150. An example item that may be displayed on the display screen of the infotainment system 135 can be an advisory provided by the warning system 150 instructing the driver 126 to brake in order to avoid colliding with an animate object.

The wireless communication system 525 may include elements such as, for example, wireless transmitters and, receivers that enable communications between the warning system 150 and various devices, such as, for example, the personal communication device 121 of the individual 120, the cloud computer 155, and/or the server computer 115. Communications transmitted by the warning system 150 to the personal communication device 121 can include text messages and/or trigger signals to transmit a warning sound through a speaker system of the personal communication device 121.

The warning system 150 may include a processor 550, an input/output interface 585, and a memory 565. In some implementations, some or all parts of the warning system 150 (such as, for example, the processor 550 and the memory 565) may be incorporated into the vehicle computer 145. The memory 565, which is one example of a non-transitory computer-readable medium, may be used to store an operating system (OS) 580 and various code modules such as, for example, a warning system module 570. The code modules are provided in the form of computer-executable instructions that can be executed by the processor 550 for performing various operations in accordance with the disclosure. More particularly, the warning system module 570 may be executed by the processor 550 for performing various operations in accordance with the disclosure, including, for example, trajectory-related computations and collision probability calculations. The input/output interface 585 may be configured, for example, to receive signals from various sensors of the sensor system 505.

In an example driver assistance procedure, the processor 550 may cooperate with a processor of the vehicle computer 145 to perform various operations such as the example operations described above. The database 575 may be used to store various types of information such as, for example, messages that may be broadcast to the individual 120, a threshold intersection probability level, and a threshold collision probability level.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," or "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

Implementations of the systems, apparatuses, devices, and methods disclosed herein may comprise or utilize one or more devices that include hardware, such as, for example, one or more processors and system memory, as discussed herein. An implementation of the devices, systems, and methods disclosed herein may communicate over a computer network. A "network" is defined as one or more data links that enable the transport of electronic data between computer systems and/or modules and/or other electronic devices. When information is transferred or provided over a network or another communications connection (either hardwired, wireless, or any combination of hardwired or wireless) to a computer, the computer properly views the connection as a transmission medium. Transmission media can include a network and/or data links, which can be used to carry desired program code means in the form of computer-executable instructions or data structures and which can be accessed by a general purpose or special purpose computer. Combinations of the above should also be included within the scope of non-transitory computer-readable media.

Computer-executable instructions comprise, for example, instructions and data which, when executed at a processor, such as the processor 550, cause the processor to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

A memory device such as the memory 565, can include any one memory element or a combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory device may incorporate electronic, magnetic, optical, and/or other types of storage media. In the context of this document, a "non-transitory computer-readable medium" can be, for example but not limited to, an electronic, magnetic, optical, electromagnetic, infrared, or semiconductor system, apparatus, or device. More specific examples (a non-exhaustive list) of the computer-readable medium would include the following: a portable computer diskette (magnetic), a random-access memory (RAM) (electronic), a read-only memory (ROM) (electronic), an erasable programmable read-only memory (EPROM, EEPROM, or Flash memory) (electronic), and a portable compact disc read-only memory (CD ROM) (optical). Note that the computer-readable medium could even be paper or another suitable medium upon which the program is printed, since the program can be electronically captured, for instance, via optical scanning of the paper or other medium, then compiled, interpreted or otherwise processed in a suitable manner if necessary, and then stored in a computer memory.

Those skilled in the art will appreciate that the present disclosure may be practiced in network computing environments with many types of computer system configurations, including in-dash vehicle computers, personal computers, desktop computers, laptop computers, message processors, handheld devices, multi-processor systems, microprocessor-based or programmable consumer electronics, network PCs, minicomputers, mainframe computers, mobile telephones, PDAs, tablets, pagers, routers, switches, various storage devices, and the like. The disclosure may also be practiced in distributed system environments where local and remote computer systems, which are linked (either by hardwired data links, wireless data links, or by any combination of hardwired and wireless data links) through a network, both perform tasks. In a distributed system environment, program modules may be located in both the local and remote memory storage devices.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description, and claims refer to particular system components. As one skilled in the art will appreciate, components may be referred to by different names. This document does not intend to distinguish between components that differ in name, but not in function.

At least some embodiments of the present disclosure have been directed to computer program products comprising such logic (e.g., in the form of software) stored on any computer-usable medium. Such software, when executed in one or more data processing devices, causes a device to operate as described herein.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that, the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A method comprising:

detecting, by a first vehicle, an object in a vicinity of the first vehicle;

determining, by the first vehicle, a hazard posed to the object; and transmitting, by the first vehicle, a warning to the object about the hazard, wherein the object is one of an individual or an animal, and wherein detecting the object in the vicinity of the first vehicle comprises detecting the one of the individual or the animal moving towards a spot between the first vehicle and a trailer that is hitched to the first vehicle.

2. The method of claim 1, wherein the hazard comprises a collision between one of the first vehicle or a second vehicle and the one of the individual or the animal.

3. The method of claim 1, wherein detecting the object in the vicinity of the first vehicle comprises detecting the one of the individual or the animal moving in front of the first vehicle and into a travel path of a second vehicle.

4. The method of claim 1, wherein detecting the object in the vicinity of the first vehicle comprises detecting the one of the individual or the animal riding on a second vehicle and within a threshold distance of the first vehicle.

5. The method of claim 4, wherein the second vehicle is one of a two-wheeled vehicle or a three-wheeled vehicle.

6. The method of claim 1, wherein transmitting the warning to the object about the hazard comprises honking a horn of the first vehicle, flashing a light of the first vehicle, activating a sound emitting device of the first vehicle, and/or transmitting a message to a device carried by the individual.

7. A method comprising:

identifying a probability of a collision between an animate object and one of a first vehicle or a second vehicle;

determining whether the probability of the collision exceeds a threshold collision probability level, wherein determining whether the probability of the collision exceeds the threshold collision probability level comprises:

determining a first trajectory of the animate object;

determining a second trajectory of the one of the first vehicle or the second vehicle;

identifying a probability of an intersection of the first trajectory and the second trajectory; and determining whether the probability of the intersection exceeds a threshold intersection probability level; and issuing a warning to the animate object upon determining that the probability of the collision exceeds the threshold collision probability level.

8. The method of claim 7, wherein the animate object is one of an individual or an animal and wherein the one of the individual or the animal is located between the first vehicle and a trailer that is hitched to the first vehicle.

9. The method of claim 7, wherein the animate object is one of an individual or an animal, wherein the first vehicle is parked and the second vehicle is moving, and wherein identifying the probability of the intersection of the first trajectory and the second trajectory comprises identifying the probability of the one of the individual or the animal being struck by the second vehicle.

10. The method of claim 7, wherein the animate object is one of an individual or an animal and wherein issuing the warning comprises the first vehicle executing actions comprising honking a horn, flashing a light, activating a sound emitting device, and/or transmitting a message to a device carried by the individual.

11. The method of claim 8, wherein the first vehicle is parked adjacent to a sidewalk and the one of the individual or the animal is moving on the sidewalk.

12. A vehicle comprising:

a sensor system; and a warning system comprising:

a memory containing computer-executable instructions; and a processor configured to access the memory and execute the computer-executable instructions to perform operations comprising:

detecting, based on information received from the sensor system, an animate object in a vicinity of the vehicle;

determining a hazard posed to the animate object; and transmitting a warning to the animate object about the hazard, wherein the sensor system includes a camera and wherein the information received from the sensor system is an image that is evaluated by the warning system to detect the animate object moving towards a spot between the vehicle and a trailer that is hitched to the vehicle.

13. The vehicle of claim 12, wherein the sensor system includes an object detector and wherein the information received from the sensor system is a trigger signal that is generated by the object detector upon detecting the animate object.

14. The vehicle of claim 12, wherein the sensor system includes a camera and wherein the information received from the sensor system is an image that is evaluated by the warning system to detect the animate object in the vicinity of the vehicle.

15. The vehicle of claim 12, wherein the animate object is an individual and wherein the warning system is configured to transmit the warning to a smart device of the individual.

16. The vehicle of claim 12, wherein determining the hazard posed to the animate object comprises:

determining a first trajectory of the animate object;

determining a second trajectory of the vehicle;

identifying a probability of an intersection of the first trajectory and the second trajectory; and determining whether the probability of the intersection exceeds a threshold intersection probability level.

* * * * *